US008247892B2

(12) United States Patent
Starovecký

(10) Patent No.: US 8,247,892 B2
(45) Date of Patent: Aug. 21, 2012

(54) ARRANGEMENT COMPRISING AT LEAST ONE POWER SEMICONDUCTOR MODULE AND A TRANSPORT PACKAGING

(75) Inventor: Stefan Starovecký, Piestany (SK)

(73) Assignee: Semikkron Elektronik GmbH & Co. KG, Nürnberg (DE)

( * ) Notice: Subject to any disclaimer, the term of this patent is extended or adjusted under 35 U.S.C. 154(b) by 10 days.

(21) Appl. No.: 13/010,621

(22) Filed: Jan. 20, 2011

(65) Prior Publication Data

US 2011/0180918 A1 Jul. 28, 2011

(30) Foreign Application Priority Data

Jan. 20, 2010 (DE) ..... 10 2010 005 047

(51) Int. Cl.
*H01L 23/02* (2006.01)

(52) U.S. Cl. ..... 257/678; 257/798; 257/691; 206/710; 206/711

(58) Field of Classification Search ..... 257/678, 257/704, 723, 724, 798, 691; 206/710, 711, 206/714, 716, 832, 564
See application file for complete search history.

(56) References Cited

U.S. PATENT DOCUMENTS

| | | | | |
|---|---|---|---|---|
| 4,654,693 | A * | 3/1987 | Funakoshi et al. | 269/287 |
| 6,244,442 | B1 | 6/2001 | Inoue et al. | |
| 6,540,073 | B1 | 4/2003 | Hagel et al. | |
| 6,653,728 | B1 * | 11/2003 | Jhong et al. | 257/697 |
| 2002/0066694 | A1 * | 6/2002 | Soh et al. | 206/725 |
| 2005/0269242 | A1 * | 12/2005 | Crisp | 206/710 |
| 2009/0090653 | A1 * | 4/2009 | Forsyth | 206/710 |
| 2011/0183496 | A1 * | 7/2011 | Kaneko | 438/473 |

FOREIGN PATENT DOCUMENTS

| | | |
|---|---|---|
| DE | 39 09 898 | 9/1990 |
| DE | 199 28 368 | 12/1999 |
| DE | 10 2006 020 636 | 11/2007 |
| GB | 1580791 | 12/1980 |

* cited by examiner

*Primary Examiner* — S. V. Clark
(74) *Attorney, Agent, or Firm* — The Law Offices of Roger S. Thompson

(57) ABSTRACT

An arrangement comprising at least one power semiconductor module and a transport packaging, wherein the power semiconductor module has a base element, a housing and connection elements and the transport packaging has a generally planar cover layer, a cover film and at least one trough-like plastic shaped body for each power semiconductor module. The at least one plastic shaped body only partly encloses the respective power semiconductor module and a part of the plastic shaped body does not directly contact the power semiconductor module. Furthermore, a first side of the at least one power semiconductor module becomes situated directly or indirectly on the first main surface of the cover layer, while the cover film covers the further sides of the power semiconductor module directly and/or indirectly, and bears at least partly against the plastic shaped body.

18 Claims, 3 Drawing Sheets

ARRANGEMENT COMPRISING AT LEAST ONE POWER SEMICONDUCTOR MODULE AND A TRANSPORT PACKAGING

BACKGROUND OF THE INVENTION

1. Field of the Invention

The invention describes an arrangement for mainly ex-works transport of at least one power semiconductor module. In this case, it is preferred to arrange a plurality of power semiconductor modules in a one- or two-dimensional matrix in transport packaging.

2. Description of the Related Art

In principle, a large number of different transport packagings for power semiconductor modules, such as simple cardboard boxes or plastic blisters having a base body and cover, are known. So-called skin packagings are known for packaging goods for end consumers. Simple cardboard boxes, for example in accordance with DE 39 09 898 A1, generally have the disadvantage that they do not provide sufficient protection for power semiconductor modules against mechanical damage during transport. A further disadvantage is that such packaging often must be opened, for example for customs inspections and, consequently, the power semiconductor modules being shipped may be subjected to direct touching, which may lead to damage resulting from electrostatic discharge or due to the disturbance of sensitive surfaces, for example silver-coated connection elements.

The so-called skin packagings such as are known from DE 199 28 368 A1, for example, form a starting point of this invention and are a combination of a cardboard box with a plastic film enclosing the product to be packaged. As is known, such packagings have the significant disadvantage that they cannot sufficiently protect particularly sensitive parts of the product to be packaged.

SUMMARY OF THE INVENTION

It is an object of the invention to provide an arrangement comprising at least one power semiconductor module and a transport packaging, wherein the latter, at least in combination with a further external packaging, is particularly robust against mechanical disturbances that may occur during transport, and is also accessible, in principle, to protection against electrostatic discharge while also providing readability of identification applied to the at least one power semiconductor module, without having to open the transport packaging.

The inventive concept is based on the skin packaging mentioned above. The skin packaging forms an arrangement which includes at least one power semiconductor module, but preferably a plurality of power semiconductor modules, arranged in a one- or two-dimensional matrix, and a transport packaging.

In its preferred embodiment, the power semiconductor module has a base element, preferably a metallic baseplate, a housing made of an insulating material and connection elements for external contact with power semiconductor components arranged internally in an insulated fashion with respect to the baseplate. In this case, the term power semiconductor module should be understood to mean, in addition to these power semiconductor modules constructed in an electrically insulated fashion in relation to the base element, also disc-type thyristors, such as have long been part of the prior art and which have two planar connection elements and an insulating material body composed of ceramic or plastic arranged therebetween. The transport packaging of the arrangement according to the invention has, for its part, a cover layer, a cover film and at least one trough-like plastic shaped body per power semiconductor module. The cover layer, preferably embodied as composite cardboard that is dissipative in its entirely, is generally planar and thus forms the base of the transport packaging.

In this case, the respective power semiconductor module is arranged in relation to the at least one plastic shaped body and party enclosed by the latter, wherein the plastic shaped body does not bear completely against the power semiconductor module, but rather is spaced apart from the latter in sections. For this purpose, it is preferred if the plastic shaped body has at least one stop surface by which it bears directly against the power semiconductor module. Adjacent thereto, at least one cavity is provided between the plastic shaped body and the power semiconductor module. The at least one cavity can, for example, if it is provided at the base element, protect a thermally conductive paste structure applied there against contact. Likewise, the at least one cavity can protect connection elements against mechanical contact during transport.

For mutually fixing the power semiconductor module and the at least one plastic shaped body arranged with respect thereto, it is advantageous if the plastic shaped body completely covers one side of the power semiconductor module and has a wall which bears against the adjacent sides of the power semiconductor module and only partly covers the adjacent sides.

The at least one plastic shaped body thus forms a spacer element between the power semiconductor module and the remaining parts of the packaging, as a result of which these parts of the packaging, in the region of the plastic shaped body, bear against the latter only indirectly rather than directly.

It may be preferred to provide the plastic shaped body between power semiconductor module and cover layer in order, for example, to protect a thermally conductive paste layer; alternatively or additionally, a further plastic shaped body can likewise be provided on the opposite side of the power semiconductor module to protect connection elements there. Likewise, a plastic shaped body arranged in this way protects the cover film from contact with the connection elements, since the latter, given corresponding configuration, could damage the cover film and, consequently, the power semiconductor module would no longer be protected from unwanted contact.

It may additionally be preferred to arrange an interlayer on the first main surface of the cover layer, wherein the interlayer has a cutout respectively for an assigned power semiconductor module. In this case, it is advantageous if the cover film is connected substantially only to the interlayer and only, in the region of the cutouts thereof, to the cover layer, which forms an easily opened transport packaging.

To protect the power semiconductor modules from electrostatic discharge, it is preferred if the cover film and/or the respective plastic shaped body consist(s) of a conductive or dissipative plastic with or without a metal-vapor-deposited outer surface. It is likewise advantageous if the cover film and/or the respective plastic shaped body is/are transparent at least in sections, but preferably completely.

The configuration of the arrangement according to the invention makes it possible

- to fix the packaged power semiconductor modules mechanically in relation to one another and at a distance from one another while also protecting sensitive locations of the power semiconductor module against mechanical damage;

to read identification applied to each power semiconductor module, including by means of optoelectronic aids such as handheld scanners, without having to open the transport packaging;

to form the transport packaging as protection against electrostatic charging;

to form the transport packaging as protection against direct action on the power semiconductor module, including by harmful gases from the environment, wherein it may furthermore be advantageous to provide a corrosion inhibitor for protecting the connection elements of the power semiconductor module on those sections of the cover layer and/or of the cover film which enclose the power semiconductor module, and to ensure simple and environmentally friendly disposal of the packaging by the separation thereof, and also by virtue of the small volume and low mass of the inventive packing when compared to known packaging.

A further preferred embodiment arises if, in the case of a plurality of power semiconductor modules arranged in a one- or two-dimensional matrix, the power semiconductor modules have, in at least one dimension parallel to the main surface of the cover layer and parallel to a normal to the surface of the housings, a distance from one another that is greater than the width of the housing with arranged plastic shaped body in that dimension. It is thus possible to combine two arrangements of this type with the first main surfaces of the cover surfaces facing one another and offset relative to one another by roughly half the distance between adjacent power semiconductor modules, to form an overall arrangement having, a high packaging density of the power semiconductor modules.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The inventive solution will be explained further on the basis of the exemplary embodiments in FIGS. 1 to 4.

DETAILED DESCRIPTION OF THE PRESENTLY PREFERRED EMBODIMENTS

Figure 1:
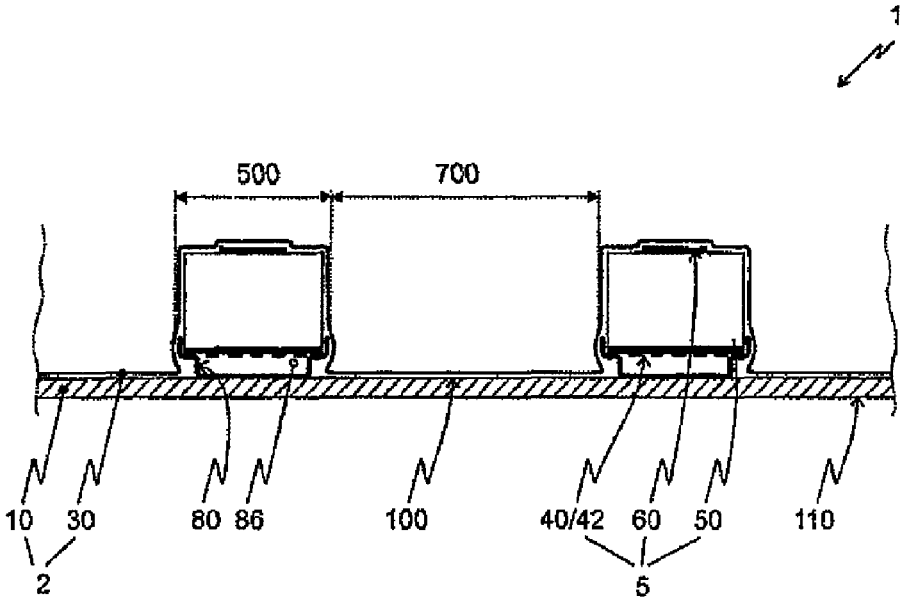
FIG. 1 shows a section through a first embodiment of the inventive packaging.

FIG. 1 shows, as an excerpt, a section along a line A-A of FIG. 4 through a first arrangement 1 according to the invention. A cover layer 10 of a transport packaging 2 has first and second main surfaces 100, 110. Power semiconductor modules 5 to be packaged are arranged on first main surface 100 of cover layer 10 in a matrix at a substantially identical distance from one another. Only a base element 40, a housing 50 and a connection element 60 of power semiconductor modules 5 to be packaged are illustrated in FIG. 1.

It is advantageous, but not necessary, to arrange power semiconductor modules 5 with their respective base elements 40, which can usually be a metallic baseplate or else directly the substrate of the internal circuit, in the direction of first main surface 100 of the cover layer 10. In the illustrated embodiment, connection elements 60 lie on the opposite side of power semiconductor module 5 from cover layer 10.

Base element 40 of power semiconductor module 5 has a thermally conductive paste layer 42 such as is known from the prior art. A plastic shaped body 80 is arranged between power semiconductor module 5 and cover layer 10 of transport packaging 2 to protect pasty layer 42, as a result of which, power semiconductor module 5 does not bear directly on first main surface 100 of cover layer 10.

Figures 3A, 3B:
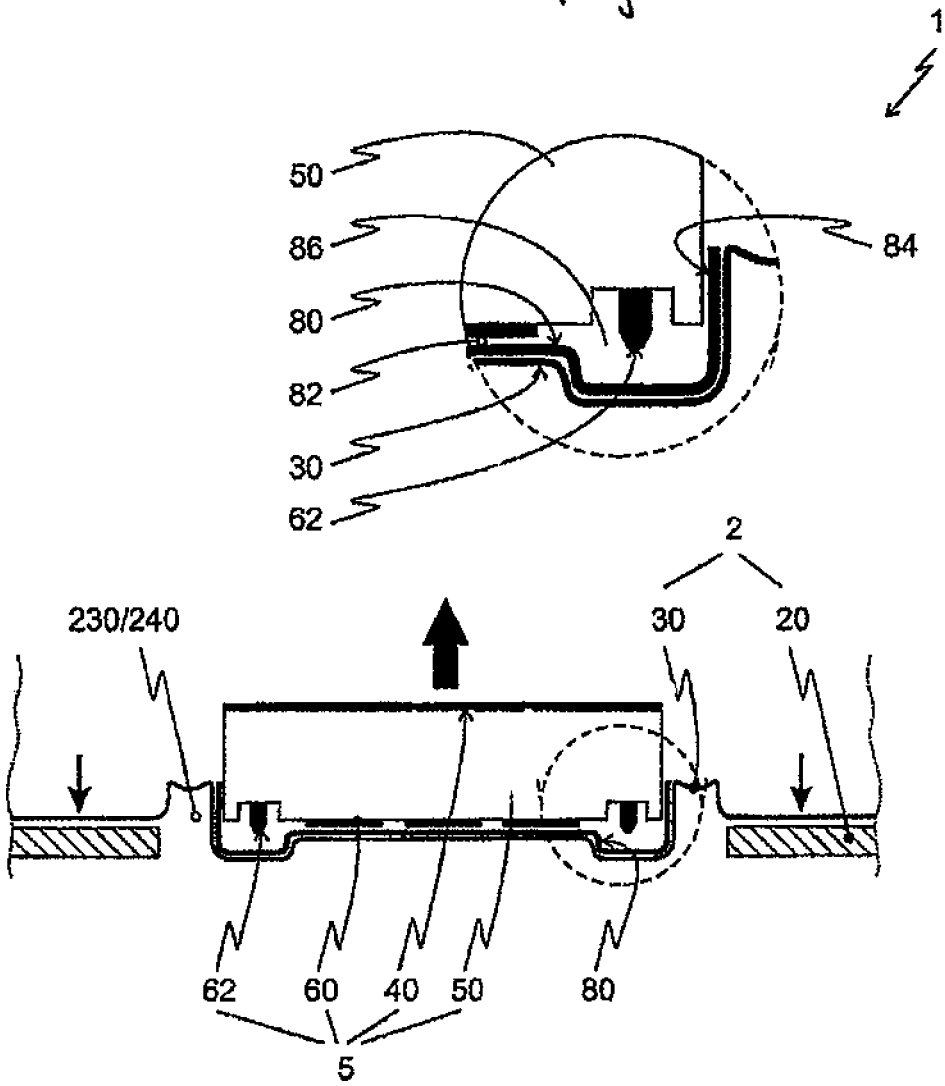
FIG. 3*a* shows a section through a third embodiment of the inventive packaging.
FIG. 3*b* shows a detail of the portion of FIG. 3*a* shown in a dashed circle.

Plastic shaped body 80 has a trough-like configuration and has a circumferentially planar supporting edge 82 (shown in FIG. 3*b*). That marginal region of base element 40 of power semiconductor module 5 which is not provided with thermally conductive paste 42 bears on this supporting surface 82. Alternatively, depending on the configuration of power semiconductor module 5, a part of housing 50 may also bear on supporting surface 82. Plastic shaped body 80 forms a cavity 86 between base element 40 provided with thermally conductive paste 42 and cover layer 10, which provides mechanical protection of thermally conductive paste 42.

For clarity herein, cover film 30 and those parts of plastic shaped body 80 which bear against power semiconductor module 5 are illustrated as spaced apart from cover layer 10 and spaced apart from power semiconductor modules 5. Cover film 30 is connected to first main surface 100 of cover layer 10 by adhesive bonding.

Cover film 30 and preferably also the plastic shaped body 80 are formed of a conductive or dissipative plastic with or without a metal-vapor-deposited outer surface. Cover layer 10 is likewise formed either from conductive or dissipative composite cardboard which gives rise to a transport packaging 2 that affords sufficient protection of the power semiconductor modules 5 against electrostatic charging. Since cover film 30 is at least partially transparent at least in sections, but preferably is completely transparent, it is also not necessary to open transport packaging 2 to inspect the contents thereof.

Figures 4A, 4B:
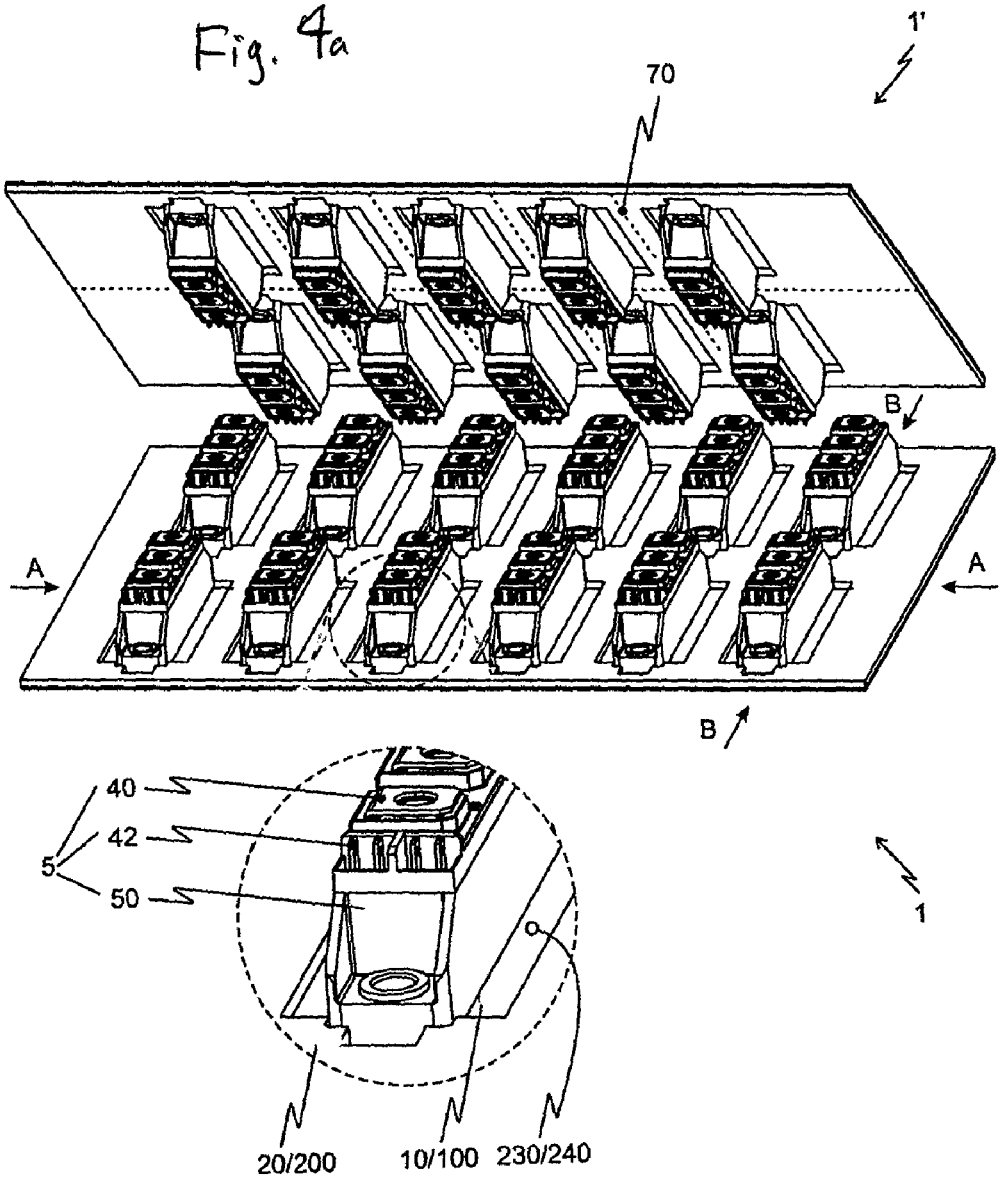
FIG. 4*a* shows a perspective view of a further embodiment of the inventive packaging.
FIG. 4*b* shows a detail of the portion of FIG. 4*a* shown in a dashed circle.

Adjacent power semiconductor modules 5 with their respective plastic shaped bodies 80 are separated by a distance 700, which is greater than the width 500 of power semiconductor module 5; as a result of which it is possible to provide a further embodiment of the inventive arrangement 1' in accordance with FIG. 4*a* offset from arrangement 1 by half the distance 700 with respect to first arrangement 1 and rotated 180° therefrom, thus resulting in a compact overall arrangement having a high packing density with at the same time sufficient fixing of individual power semiconductor modules 5 with respect to one another.

Figure 2:
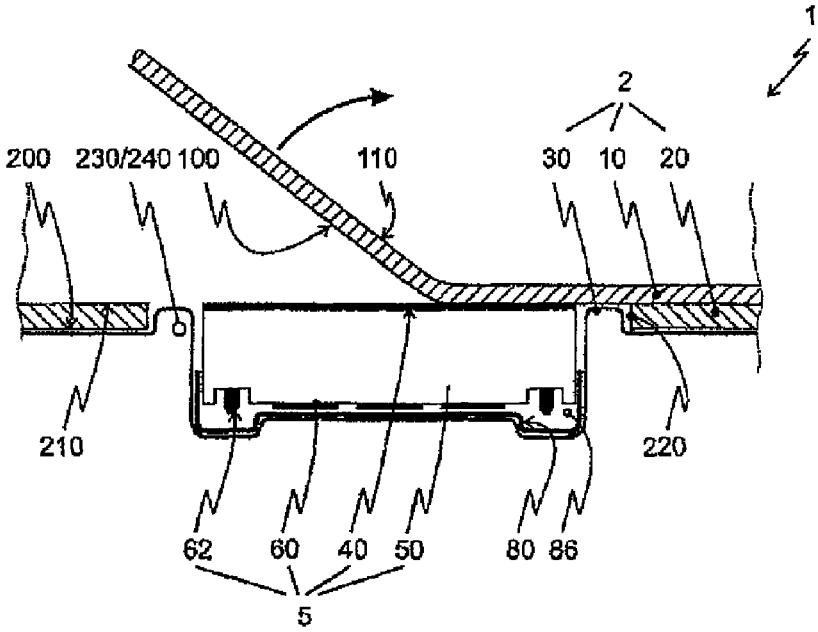
FIG. 2 shows a section through a second embodiment of the inventive packaging.

FIGS. 2 and 3*a/b* each show a section along a line B-B of FIG. 4*a* through a still further embodiment of inventive arrangement 1, wherein transport packaging 2 is illustrated in a developed fashion once again. Transport packaging 2 now has an additional interlayer 20 with a respective cutout 230 assigned to a power semiconductor module 5, as a result of which assigned power semiconductor module 5, in its lower region, is enclosed without any portion of transport packaging 2 bearing directly therein. On the periphery of power semiconductor module 5 it is advantageous that an edge 220 of the cutout 230 bears to the extent of at most about 50%, preferably only to the extent of at most about 25%, directly against assigned power semiconductor module 5 and the remaining part of edge 220 is at a distance of at least about 2 mm from power semiconductor module 5 and thus forms an intermediate region 240. However, direct bearing is expedient at least at some locations, preferably in the corners of the power semiconductor module 5, so that the fixing of the power semiconductor modules 5 in their position with respect to one another is ensured.

It is in principle preferred but not necessary, to provide, alongside the adhesive-bonding connection between cover film 30 and interlayer 20, adhesive-bonding connections also between cover layer 10 and cover film 30 in intermediate region 240, and also between cover layer 10 and interlayer 20. The first-mentioned adhesive bonding connection need not be embodied as a detachable connection.

FIG. 2 shows an arrangement 1 with power semiconductor module 5 and also transport packaging 2. In this embodiment, cover layer 10 is illustrated as partly separated from interlayer 20. This illustration corresponds to the opening of transport packaging 2 in order to remove a power semiconductor module 5 therefrom. In this case, the detachable connection between cover layer 10 and interlayer 20 and/or that between cover layer 10 and cover film 30 are/is separated in intermediate region 240.

Preferably, but non-necessarily, interlayer 20 and cover layer 10 are formed of paperboard, cardboard or composite cardboard. It has proved to be particularly advantageous for protection against electrostatic discharge to form interlayer 20 and, preferably, cover layer 10 of conductive or dissipative composite cardboard. The latter then has, for example, a conductive or dissipative film interlayer.

In this embodiment, plastic shaped body 80 is arranged on that side of power semiconductor module 5 which is remote from cover layer 10, in order to protect load and auxiliary connections element 60, 62 against mechanical damage during transport. For this purpose, plastic shaped body 80 has a stop surface 82 (FIG. 3) with load connection elements 60, and, adjacent thereto, in each case a cavity 86 for auxiliary connection elements 62. Cavity 86 prevents respective auxiliary connection elements 62 from being able to damage cover film 30 on account of their configuration as plugs. Consequently, other connection elements 60, 62, formed as filigrees, can likewise be protected against damage from outside. In this case, as is generally preferred, plastic shaped body 80 covers the entire side of power semiconductor module 5 that has connection elements.

Plastic shaped body 80 furthermore has a wall 84 (FIG. 3*b*) on at least two opposite, but preferably on all, sides. Wall 84 bears against those sides of power semiconductor module 5 which adjoin the covered side. In this case, it is preferred for walls 84 to only partly cover the respective sides.

Typical power semiconductor modules 5 according to a preferred embodiment of the invention have a length in the range of from about 3 cm to about 15 cm and a width 500 including plastic shaped body 80 and a height of from about 1 cm to about 6 cm. Cover layer 10 of transport packaging 2 has a typical thickness of from about 0.2 mm to about 1 mm, interlayer 20 preferably has a thickness of from about 0.5 to about 3 mm, while cover film 30 has a thickness of the order of magnitude of about 100 μm. Plastic shaped body 80 preferably has a thickness which is greater than that of cover film 30 by at least a factor of 5.

FIG. 3*a/b* shows a further step of removing a power semiconductor module 5 from transport packaging 2. In this case, interlayer 20 was pressed in the direction of the surface normal to its first main surface 200 until interlayer 20 lay approximately in the plane formed by the top side of housing 50. In the course of this displacement of interlayer 20, cover film 30 detaches at least partly from housing 50 of power semiconductor module 5 and then bears exclusively or at least almost exclusively still against walls 84 of plastic shaped body 80, as a result of which power semiconductor module 5 can be removed from said plastic shaped body 80 simply without employing a tool.

FIGS. 4*a/b* show, in perspective, two arrangements 1, 1' according to the invention, similar to those in accordance with FIGS. 1, 2 and 3, each comprising a transport packaging 2 and a plurality of power semiconductor modules 5. Housing 50 and a plurality of connection elements 60, 62 of said power semiconductor modules 5 are illustrated in each case. By their—not shown—base element (40, see FIG. 1), here a metallic baseplate, power semiconductor modules 5 are arranged in a two-dimensional matrix on first main surface 100 of cover layer 10 of the respective transport packaging 2 by virtue of the base element (40, see FIG. 2) becoming situated thereon in each case directly or, as described above, indirectly with a plastic shaped body 80 arranged therebetween.

An interlayer 20 is arranged by its second main surface 210 on first main surface 100 of cover layer 10. Interlayer 20 has a plurality of cutouts 230 each assigned to a respective power semiconductor module 5. In this case, the power semiconductor module 5 is arranged in cutout 230 in such a way that edge 220 of cutout 230 bears directly against housing 50 of power semiconductor module 5 only at a few sections. A spacing is predominantly provided between housing 50 of power semiconductor module 5 and edge 220 of cutout 230, the spacing forming an intermediate region 240.

Transparent cover film 30 and respective plastic shaped bodies 80 themselves are not illustrated. In the case of a plurality—illustrated here—of power semiconductor modules 5 in a two-dimensional matrix arrangement, it is furthermore advantageous, just like in the case of a one-dimensional arrangement (such as one line of the illustrated two-dimensional matrix), if the transport packaging 2, here only illustrated in the case of the second arrangement 1', has a perforation 70 between respective power semiconductor components 5 to simplify the singulation of the packaged power semiconductor modules 5.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve substantially the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An arrangement comprising:

at least one power semiconductor module having a base element, a housing and connection elements; and a transport packaging having a generally planar cover layer, a cover film and at least one trough-like plastic shaped body for each of said at least one power semiconductor module, said cover layer including a main first surface;

wherein each at least one body only partly encloses its respective power semiconductor module and a part thereof does not bear directly against said respective power semiconductor module;

wherein a first side of said at least one power semiconductor module is situated on said first main surface of said cover layer; and wherein said cover film covers the further sides of said at least one power semiconductor module, and bears at least partly against said body.

2. The arrangement of claim 1, wherein each of said bodies has at least one stop by which it bears directly against its respective power semiconductor module and, adjacent thereto, at least one cavity is disposed between said body and said power semiconductor module.

3. The arrangement of claim 1, wherein each said body completely covers one side of its respective power semiconductor module and has a wall that bears against the adjacent sides of its respective power semiconductor module and only partly covers said adjacent sides.

4. The arrangement of claim 2, wherein each said body completely covers one side of its respective power semiconductor module and has a wall that bears against the adjacent sides of its respective power semiconductor module and only partly covers said adjacent sides.

5. The arrangement of claim 1, wherein at least one of said cover film and said body is formed from a conductive plastic.

6. The arrangement of claim 1, wherein at least one of said cover film and said body is formed from a dissipative plastic.

7. The arrangement of claim 1, wherein at least one of said cover film and said body includes a metal-vapor-deposited outer surface.

8. The arrangement of claim 1, wherein at least one of said cover film and said body lacks a metal-vapor-deposited outer surface.

9. The arrangement of claim 1, wherein at least one of said cover film and said body is at least partially transparent in sections.

10. The arrangement of claim 9, wherein at least one of said cover film and said body is substantially completely transparent.

11. The arrangement of claim 1, wherein said cover film has a thickness which is smaller than that of said plastic shaped body by at least a factor of 5.

12. The arrangement of claim 1, wherein said transport packaging has an additional interlayer with a cutout assigned to said at least one power semiconductor module and said interlayer is arranged by a second main surface thereof on said first main surface of said cover layer and said power semiconductor module is arranged in said cutout.

13. The arrangement of claim 12, wherein said cover layer and said interlayer are detachably connected to one another.

14. The arrangement of claim 12, wherein said cover film is detachably connected to said first main surface of said cover layer in an intermediate region cut free by the respective cutout alongside said power semiconductor component.

15. The arrangement of claim 1, wherein said cover layer is formed of one of the group consisting of paperboard, cardboard and composite cardboard.

16. The arrangement of claim 12, wherein at least one of said interlayer and said cover layer is formed of one of the group consisting of paperboard, cardboard and composite cardboard.

17. The arrangement of claim 1, wherein said at least one power semiconductor modules includes a plurality of power semiconductor modules arranged in a matrix, and wherein said plurality of power semiconductor modules are separated from one another, in a dimension parallel to said first main surface of said cover layer and parallel to a normal to a surface of said housings, by a distance that is greater than a width of said housing including body in said dimension.

18. The arrangement of claim 1, wherein said at least one power semiconductor modules includes at least two power semiconductor modules arranged in a matrix, and said transport packaging includes a perforation between adjacent ones of said at least two power semiconductor components.

* * * * *